US007320151B2

(12) United States Patent
Oka

(10) Patent No.: US 7,320,151 B2
(45) Date of Patent: Jan. 22, 2008

(54) VACUUM CLEANER

(75) Inventor: Yasuhiro Oka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 370 days.

(21) Appl. No.: 11/179,935

(22) Filed: Jul. 12, 2005

(65) Prior Publication Data

US 2006/0010640 A1 Jan. 19, 2006

(30) Foreign Application Priority Data

Jul. 16, 2004 (JP) ..... 2004-210829

(51) Int. Cl.
*A47L 15/14* (2006.01)

(52) U.S. Cl. ..... 15/345; 15/346; 15/327.3

(58) Field of Classification Search ..... None
See application file for complete search history.

(56) References Cited

U.S. PATENT DOCUMENTS 4,204,298 A * 5/1980 Handa et al. ..... 15/344
5,930,864 A * 8/1999 Inoue et al. ..... 15/346
5,974,625 A 11/1999 Garner
2002/0129461 A1 9/2002 Wegelin et al.

FOREIGN PATENT DOCUMENTS

JP 3468401 5/2003

* cited by examiner

*Primary Examiner*—David Redding
(74) *Attorney, Agent, or Firm*—Renner, Otto, Boisselle & Sklar, LLP

(57) ABSTRACT

An electric vacuum cleaner of the present invention includes: a base plate connected to the lower face of a cleaner body so that the base plate is freely movable up and down, and having an exhaust hole formed in a surface facing the surface to be cleaned for blowing exhaust air; an extensible air duct, interposed between the base plate and the cleaner body, for guiding the exhaust air from an intake fan to the base plate; a dust suction nozzle supported on a part of the base plate and connected to the suction side of the intake fan; and wheels, mounted on the lower face of the cleaner body, for supporting the cleaner body on the surface to be cleaned when the base plate is moved up.

8 Claims, 6 Drawing Sheets

VACUUM CLEANER

CROSS-REFERENCE TO RELATED APPLICATION

This non-provisional application claims priority under 35 U.S.C. §119(a) on Patent Application No. 2004-210829 filed in Japan on Jul. 16, 2004, the entire contents of which are hereby incorporated by reference.

BACKGROUND OF THE INVENTION

1. Field of the Invention

The present invention relates to an electric vacuum cleaner that comprises a cleaner body incorporating an intake fan for sucking dust, and is supported in a floating manner on a surface to be cleaned by the function of exhaust air from the intake fan.

2. Description of Related Art

In an electric vacuum cleaner that sucks dust by using negative pressure produced on the suction side of an intake fan and collects the dust in a dust collection chamber provided in a mid part of an intake channel, the intake fan including a drive motor is a heavy load. Therefore, in general, the cleaner body incorporating the intake fan is supported by carrier wheels, a dust suction nozzle is connected to the clearer body and attached to an end of an extension hose connected to the suction side of the intake fan, the dust suction nozzle is operated by holding a grip provided in a mid part of the extension hose, and a dust suction port formed in the dust suction nozzle is pressed against a surface to be cleaned and slipped so as to suck dust on the surface to be cleaned.

Such an electric vacuum cleaner has the problem of inconvenient use because it is difficult to control the cleaner body that moves by following the above-mentioned operation of the dust suction nozzle through the rolling of the wheels on a surface to be cleaned.

As one means for solving this problem, an electric vacuum cleaner is proposed, which supports the cleaner body incorporating the intake fan in a floating manner on a surface to be cleaned, and moves and controls the cleaner body in a floating state by pushing and pulling a control handle attached to a part of the cleaner body (see, for example, Japanese Patent No. 3468401).

This electric vacuum cleaner has a dust suction port formed in the lower face of the cleaner body facing a surface to be cleaned and connected to the suction side of the intake fan, and an exhaust port connected to the outlet side of the intake fan. The electric vacuum cleaner sucks and collects dust from the dust suction port by negative pressure produced on the suction side when the intake fan is driven, while blows exhaust air of positive pressure produced on the outlet side onto the surface to be cleaned through the exhaust port, and supports the cleaner body in a floating manner on the surface to be cleaned by the function of the exhaust air.

With this structure, by applying slight force to the grip, it is possible to move the cleaner body supported in a floating manner on a surface to be cleaned in various directions without resistance over the surface to be cleaned, thereby facilitating handling of the electric vacuum cleaner and achieving more convenient use.

However, in the electric vacuum cleaner disclosed in Japanese Patent No. 3468401, since the dust suction port and the exhaust port are formed side by side in the lower face of the cleaner body, there is a possibility that the exhaust air blown from the exhaust port may interfere with the suction of dust into the dust suction port. Moreover, when the cleaner body floats from a surface to be cleaned due to the function of the exhaust air, the dust suction port also separates from the surface to be cleaned, and therefore there is a problem that the force of sucking dust into the dust suction port decreases and it is hard to achieve desired dust sucking efficiency.

In addition, when the intake fun is not driven, since there is no floating force caused by exhaust air, the whole cleaner body is in contact with a surface to be cleaned. In this state, it is difficult to move the electric vacuum cleaner, and forced movement and operation may damage the surface to be cleaned.

Further, since the dust collection chamber in a mid part of the intake channel is integrally formed together with the intake fan, intake channel and discharge channel inside the cleaner body, the cleaner body that is caused to float by the function of exhaust air becomes larger in size and may cause problems in the operation on a surface to be cleaned.

BRIEF SUMMARY OF THE INVENTION

The present invention has been made with the aim of solving the above problem, and it is an object of the present invention to provide an electric vacuum cleaner capable of supporting a cleaner body in a floating manner without affecting the dust sucking performance during a cleaning operation, smoothly handling the electric vacuum cleaner to achieve convenient use, and easily moving the cleaner body during non-cleaning.

An electric vacuum cleaner according to the present invention is an electric vacuum cleaner including a cleaner body incorporating an intake fan for generating suction for sucking dust and supported in a floating manner on a surface to be cleaned by exhaust air blown from the intake fan, and characterized by comprising: a base plate connected to a lower face of the cleaner body so that the base plate is freely movable up and down and having an outlet of the exhaust air formed in a surface thereof facing the surface to be cleaned; an extensible air duct, interposed between the base plate and the cleaner body, for guiding the exhaust air from the intake fan to the base plate; a dust suction nozzle supported on a part of the base plate and connected to a suction side of the intake fan; and wheels, mounted on the lower face of the cleaner body, for supporting the cleaner body on the surface to be cleaned when the base plate is moved up.

According to the present invention, the outlet of exhaust air is formed in the base plate connected to the cleaner body through the extensible air duct, and the dust suction nozzle is supported on the base plate. During a cleaning operation in which exhaust air is produced by driving the intake fan, the exhaust air is blown onto a surface to be cleaned from the outlet in the base plate moved down, and the cleaner body is supported in a floating manner through the base plate without affecting the dust sucking performance of the dust suction nozzle, thereby realizing smooth movement. Moreover, the wheels are mounted on the lower face of the cleaner body. During a time other than a cleaning operation, in which the intake fan is not driven, the cleaner body is supported by the wheels that roll in contact with a surface to be cleaned due to an upward movement of the base plate, and the cleaner body is easily moved with the rolling of the wheels, thereby preventing damage to the surface to be cleaned.

Further, an electric vacuum cleaner according to the present invention is characterized in that the air duct is extended or contracted according to passage or non-passage of the exhaust air, and also acts as an actuator for moving up and down the base plate.

In this invention, the air duct is extended or contracted by the function of exhaust air passing through the inside, and this extending or contracting motion are used to move up and down the base plate, thereby realizing the floating cleaner body during a cleaning operation without using a special actuator.

Further, an electric vacuum cleaner according to the present invention is characterized in that a plurality of the air ducts are provided between the base plate and the cleaner body, and the air ducts are bellows type tubes having a bellows-like circumferential surface.

In this invention, a plurality of air ducts that also act as an actuator are provided to stably support the cleaner body through the base plate, and the air ducts that are extended by the function of air passing through the inside are more easily realized using bellows type tubes.

Further, an electric vacuum cleaner according to the present invention is characterized in that a plurality of the outlets are formed in a surface of the base plate facing the surface to be cleaned, and a plurality of the wheels are mounted on the lower face of the cleaner body.

In this invention, with the exhaust air blown from a plurality of outlets, the cleaner body is stably supported in a floating manner during a cleaning operation. Moreover, with a plurality of wheels, the cleaner body is stably supported during non-cleaning.

Further, an electric vacuum cleaner according to the present invention is characterized in that the dust suction nozzle is supported so that the dust suction nozzle is displaceable in a vertical direction with respect to the base plate.

In this invention, the dust suction nozzle is displaced in a vertical direction with respect to the base plate that is caused to float by the exhaust air blowing and moves on a surface to be cleaned, and the dust suction port approaching the surface to be cleaned is kept in a correct facing state to prevent a deterioration in the dust sucking performance.

In an electric vacuum cleaner according to the present invention, the exhaust air is guided to the base plate which is connected to the cleaner body so that the base plate is freely movable up and down, the cleaner body is supported in a floating manner by blowing the exhaust air onto a surface to be cleaned from the outlet formed in the base plate, and the dust suction nozzle is supported on a part of the base plate. Therefore, it is possible to realize the floating cleaner body without affecting the dust sucking performance of the dust suction nozzle, and it is possible to achieve high dust sucking performance and good controllability together during a cleaning operation. Moreover, since the wheels are mounted on the cleaner body and a movement of the cleaner body during non-cleaning in which the exhaust air is not blown from the base plate is enabled by the rolling of the wheels, it is possible to easily move the cleaner body and prevent a surface to be cleaned from being damaged by forced movements.

In addition, since the extension and contraction of the air duct for guiding the exhaust air to the base plate are used to move up and down the base plate, it is possible to support the cleaner body in a floating manner by a simple structure requiring no special actuator. Moreover, since a plurality of the air ducts are provided, it is possible to stably support the cleaner body in a floating manner. Further, since the air ducts are bellows type tubes, it is possible to easily realize the air ducts that also act as an actuator.

Besides, since a plurality of outlets of exhaust air are formed in the base plate, the cleaner body in a cleaning operation can be stably supported in a floating manner by the exhaust air from these outlets. Moreover, since a plurality of wheels are mounted on the cleaner body, it is possible to stably support the cleaner body by these wheels during non-cleaning.

Further, since the dust suction nozzle is supported so that the dust suction nozzle is displaceable in a vertical direction with respect to the base plate, the dust suction nozzle can be kept facing a surface to be cleaned, irrespective of a displacement of the base plate in a vertical direction, and the present invention produces advantageous effects such as satisfactory dust sucking performance.

The above and further objects and features of the invention will more fully be apparent from the following detailed description with accompanying drawings.

DETAILED DESCRIPTION OF THE INVENTION

Figure 1:
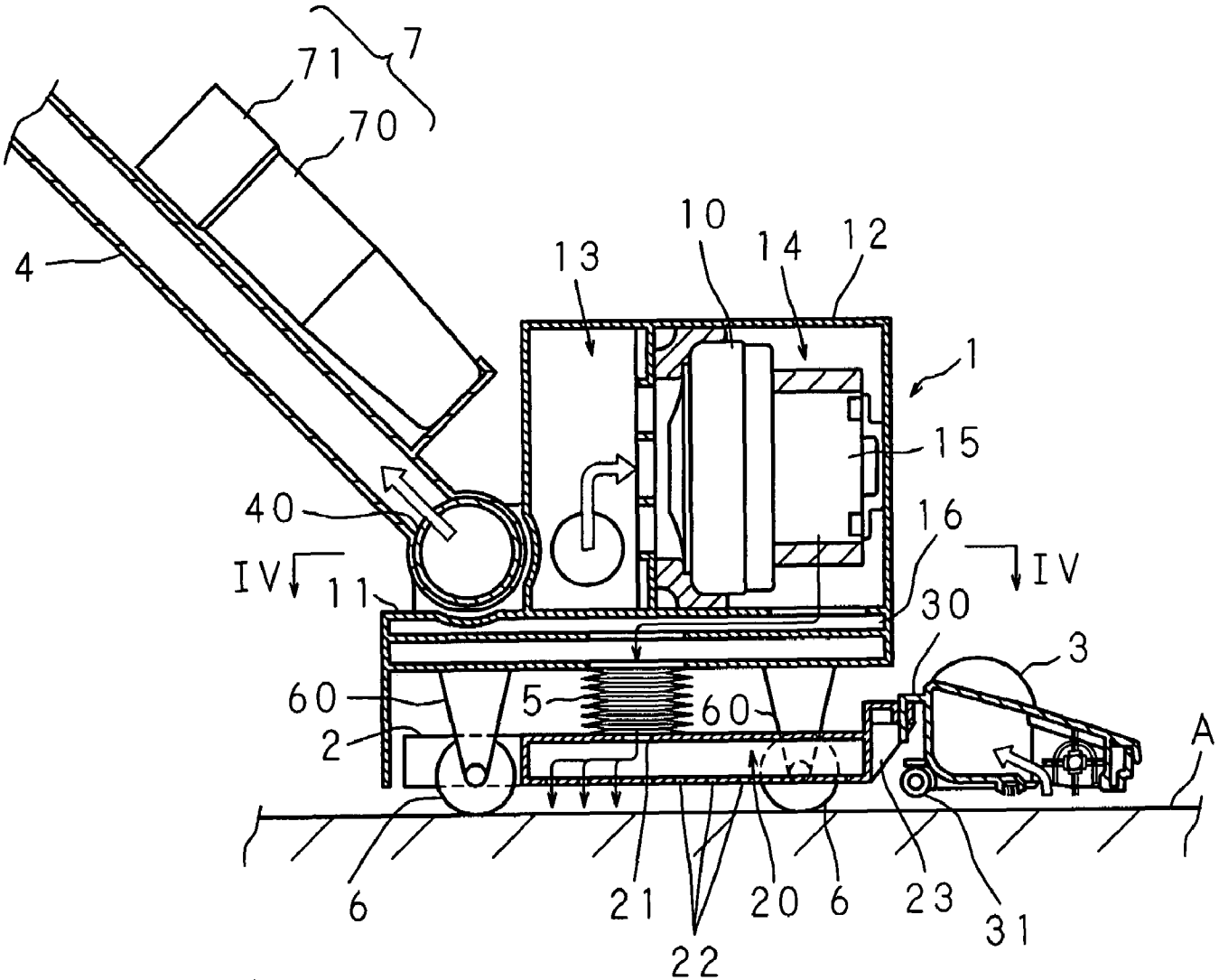
FIG. 1 is a sectional side view showing a first embodiment of an electric vacuum cleaner according to the present invention.

The following description will explain in detail the present invention based on the drawings illustrating some embodiments thereof. FIG. 1 is a sectional side view showing a first embodiment of an electric vacuum cleaner according to the present invention. The electric vacuum cleaner shown in FIG. 1 comprises a cleaner body 1 incorporating an intake fan 10 for generating suction for sucking dust; a base plate 2 connected to the lower side of the cleaner body 1; a dust suction nozzle 3 supported on one side (front side) of the base plate 2; and a control handle 4 mounted on the rear side of the cleaner body 1.

The cleaner body 1 is constructed so that the inside of a fan housing 12 fixedly mounted on the upper face of a base 11 in the form of a flat plate is divided into a suction chamber 13 and a discharge chamber 14, and a dust suction port of the intake fan 10, secured in the discharge chamber 14 is open in the suction chamber 13. The intake fan 10 is a centrifugal fan that is driven and rotated by the supply of power to an integrated drive motor 15, and when the intake fan 10 is driven, the air is continuously sucked into the intake fan 10 from the suction chamber 13 and pressurized inside the intake fan 10, emitted to the periphery, and discharged into the discharge chamber 14.

The base 11 of the cleaner body 1 is entirely hollow as shown in FIG. 1, and has an exhaust chamber 16 connected to the discharge chamber 14 in the fan housing 12 through a connection hole formed through a corresponding position in the top face. In the bottom surface of the exhaust chamber 16, a connection hole is formed to pass through a substantially center portion to the inside and outside. An air duct 5 is fixedly mounted on the outside of the opening position of this connection hole, and the base plate 2 is connected to the other end of the downward extending air duct 5.

Figure 2:
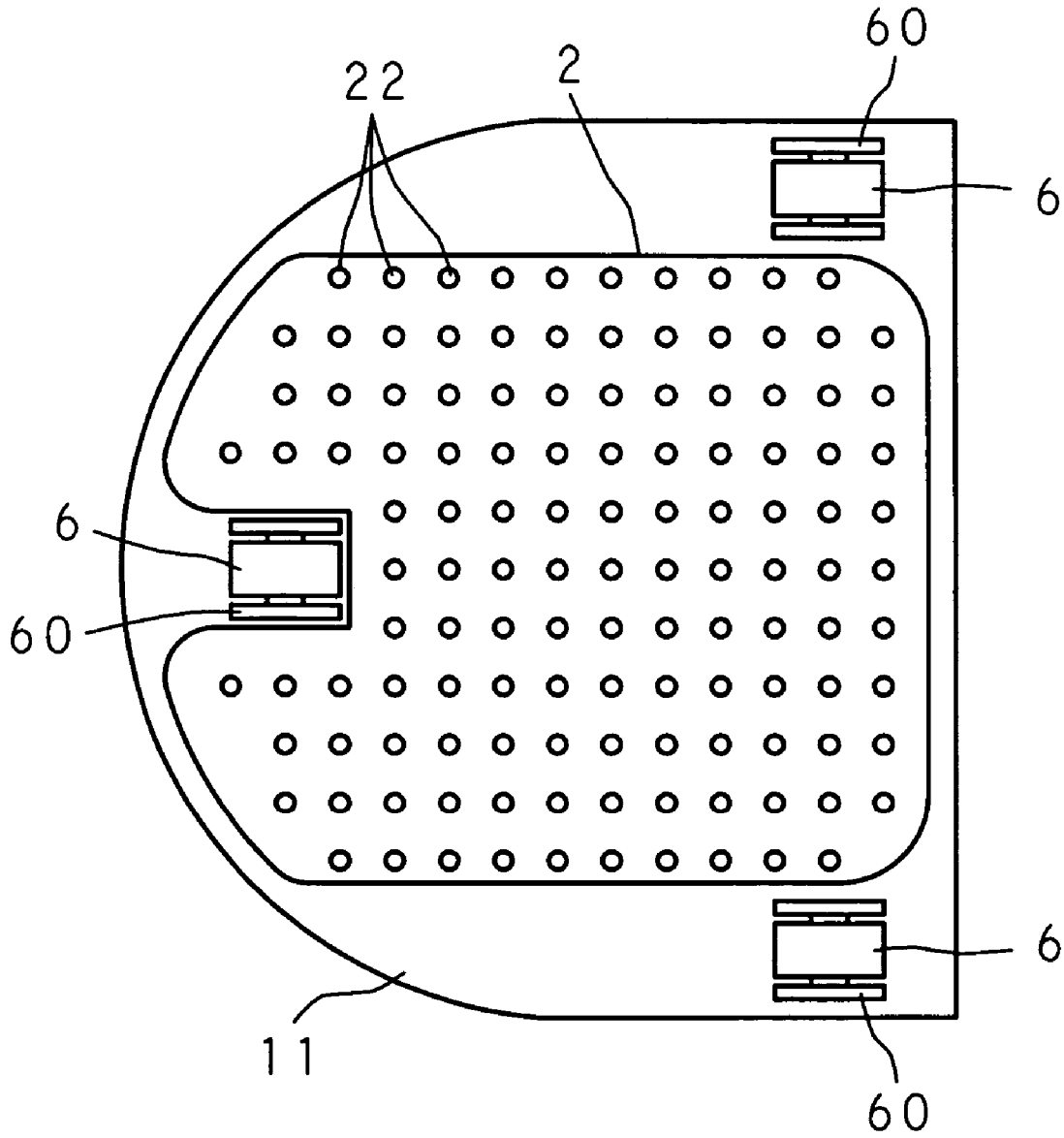
FIG. 2 is a plan view of the lower face of a base plate.

As shown in FIG. 1, the air duct 5 is constructed as a vertically extensible bellows type tube with a bellows-like circumferential surface. When the air duct 5 is in a contracted state as shown in FIG. 1, it has resiliency capable of pulling up the base plate 2. In the inside of the base plate 2 thus supported by the air duct 5, an exhaust chamber 20 that is entirely hollow similarly to the above-mentioned base 11 is provided, and the exhaust chamber 20 is connected to the inside of the air duct 5 through a small-diameter connection hole 21 formed through a corresponding position in the top face. Moreover, a plurality of exhaust holes 22, 22 . . . as exhaust air outlets are formed through suitable positions in the bottom surface of the exhaust chamber 20 over the entire surface. FIG. 2 is a plan view of the lower face of the base plate 2, and shows an example of the arrangement of the exhaust holes 22, 22 . . . .

The above-mentioned dust suction nozzle 3 is attached to the front part of the base plate 2 thus supported by the air duct 5. The dust suction nozzle 3 has a known structure where the dust suction port is formed in the lower face of the front part, an engagement claw 30 formed along the rear edge is brought into engagement with an engagement edge 23 extending along the front edge of the base plate 2, and the dust suction nozzle 3 is supported to allow for a relative displacement within a predetermined stroke in the vertical direction. Moreover, the dust suction nozzle 3 comprises a support roller 31 suspended along the rear side of the dust suction port. When the base plate 2 pushed down by a later-described extension of the air duct 5, the support roller 31 rolls in contact with a surface A to be cleaned, and performs the function of supporting the dust suction nozzle 3. Note that the illustration of the dust suction nozzle 3 is omitted in FIG. 2.

Further, in the lower face of the base 11 of the cleaner body 1, two wheels 6 and 6 are attached to the left and right of the front part, and one wheel 6 is attached to the center of the rear part. These wheels 6 are attached to the end of downward projecting blankets 60, 60, 60, respectively, so that they can turn around the horizontal axis. When the base plate 2 is pulled up by a contraction of the air duct 5 as shown in FIG. 1, these wheels 6, 6 and 6 roll in contact with the surface A to be cleaned and performs the function of supporting the cleaner body 1. FIG. 2 shows a plan view of the arrangement of the three wheels 6, 6 and 6, and these wheels are arranged so as to avoid interference with the base plate 2.

Figure 3:
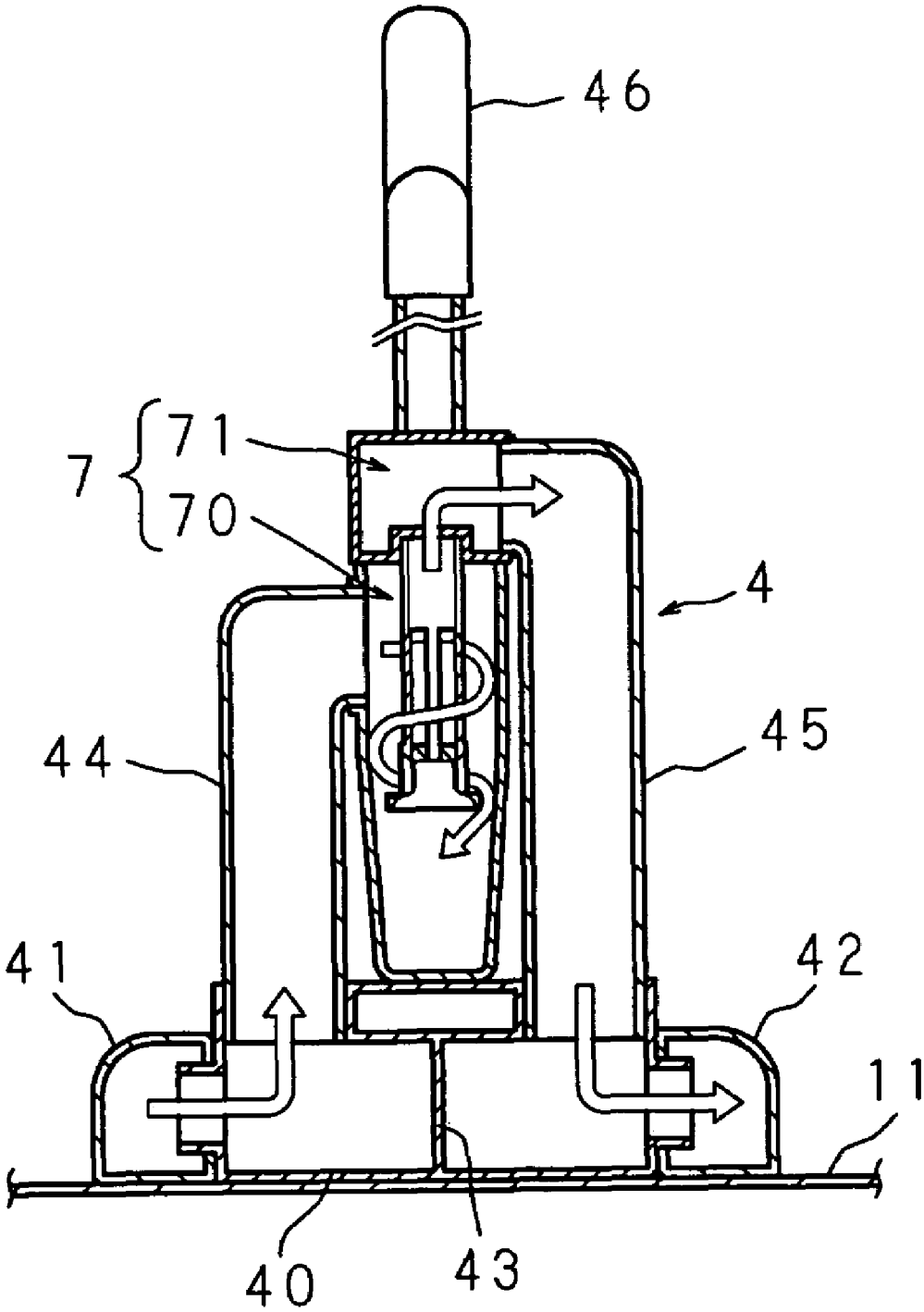
FIG. 3 is a sectional front view showing the mount state of a control handle.
Figure 4:
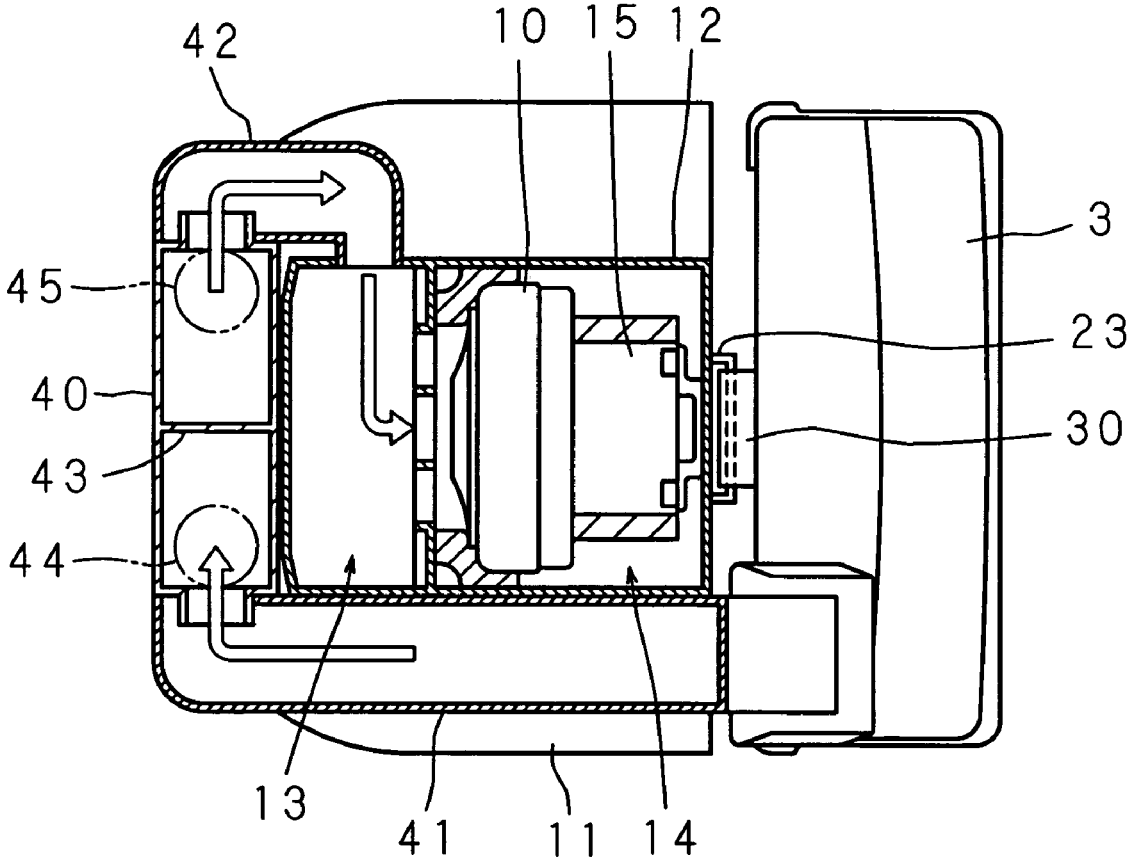
FIG. 4 is a sectional plan view across the IV-IV line of FIG. 1.

In addition, on the upper face of the base 11 of the cleaner body 1, a suction air duct 40 is transversely mounted along the rear side of the fan housing 12, and the control handle 4 is mounted so as to swing about the suction air duct 40 as a pivot. FIG. 3 is a sectional front view showing the mount state of the control handle 4, and FIG. 4 is a sectional plan view across the IV-IV line of FIG. 1. The connected state of the suction air duct 40 functioning as a pivot of the control handle 4 is shown.

As shown in FIG. 3, the suction air duct 40 functioning as a pivot of the control handle 4 is supported by fitting both ends into first and second intake channels 41 and 42 which are fixedly mounted on both sides of the base 11 in the width direction. The inside of the suction air duct 40 is divided into two chambers by a partition wall 43 provided at the center. The lower part of the control handle 4 is branched off into first and second connection pipes 44 and 45 constructed as hollow pipe members, and the lower ends of these first and second connection pipes 44 and 45 are fitted and fixed on the circumferential surface of the suction air duct 40 and connected to first and second intake channels 41 and 42 through the two chambers separated by the partition wall 43.

As shown in FIGS. 1 and 3, a cyclone dust collector 7 is installed in a mid part of the control handle 4. The cyclone dust collector 7 has a known structure comprising a dust collection chamber 70, and an exhaust chamber 71 located above and connected to the dust collection chamber 70. The upper end of the first connection pipe 44 is fitted and fixed into the circumferential surface of the dust collection chamber 70 along a tangential direction, while the upper end of the second connection pipe 45 is fitted and fixed into the circumferential surface of the exhaust chamber 71. With this structure, in the cyclone dust collector 7, a cyclone air stream is produced by the suction air guided into the dust collection chamber 70 from the first connection pipe 44, and the dust contained in the suction air are separated by the function of centrifugal force and collected at the bottom of the dust collection chamber 70, while clean air from which dust were separated is guided into the exhaust chamber 71 and fed into the second connection pipe 45.

As shown in FIG. 3, a grip 46 for pulling and pushing the cleaner body 1 as to be described later is fixed to the upper end of the control handle 4. A user who holds the grip 46 can adjust the tilt angle of the control handle 4 by a swing motion about the suction air duct 40 as a pivot, and can move the cleaner body 1 forward and backward and left and right by applying pushing and pulling forces to the grip 46.

As shown in FIG. 4, the first intake channel 41 fixedly mounted on one side of the base 11 in the width direction is extended forward along the outer surface of the fan housing 12 on the same side and connected to the dust suction nozzle 3. Similarly, the second intake channel 42 fixedly mounted on the other side of the base 11 in the width direction is extended forward along the outer surface of the fan housing 12 on the same side and connected to the suction chamber 13 formed in the fan housing 12.

As shown in FIG. 1, the electric vacuum cleaner of the present invention thus constructed is used by supporting the cleaner body 1 on the surface A to be cleaned with the wheels 6, 6 and 6 mounted on the bottom of the base 11 and driving the intake fan 10 by turning on the operation switch (not shown).

When the intake fan 10 is driven, as described above, the air is continuously sucked from the suction chamber 13 located on one side in the fan housing 12, and discharged into the discharge chamber 14. The suction chamber 13 is connected to the cyclone dust collector 7 through the second intake channel 42, a half part on one side of the suction air duct 40 and the second connection pipe 45, while the cyclone dust collector 7 is connected to the dust suction nozzle 3 through the first connection pipe 44, a half part on the other side of the suction air duct 40 and the first intake channel 41.

Therefore, when the intake fan 10 is driven, suction of air into the dust suction port formed in the lower face of the front part of the dust suction nozzle 3 is produced, and the suction air is guided into the cyclone dust collector 7 through the first intake channel 41, suction air duct 40 and first connection pipe 44. After removing dust by the function of cyclone air stream produced as described above, the suction air is guided into the suction chamber 13 through the second connection pipe 45, suction air duct 40 and second intake channel 42. Such a flow of suction air is shown by the open arrows in FIGS. 1, 3 and 4.

The suction air thus guided into the suction chamber 13 is continuously sucked by the intake fan 10, pressurized in the intake fan 10, and then discharged into the discharge chamber 14. Here, the discharge chamber 14 is connected to the exhaust chamber 16 in the base 11, and the exhaust chamber 16 is connected to the exhaust chamber 20 in the base plate 2 through the air duct 5. Therefore, the exhaust air of positive pressure discharged into the discharge chamber 14 is guided into the exhaust chamber 20 through the exhaust chamber 16 and air duct 5, and discharged to the outside through a plurality of exhaust holes 22, 22, . . . formed through the bottom face of the exhaust chamber 20. Such a flow of exhaust air is shown by the arrows in FIG. 1.

In such a flow of exhaust air, the inflow of exhaust air into the exhaust chamber 20 from the air duct 5 occurs through the connection hole 21 which is formed through the top face of the exhaust chamber 20. Here, since the connection hole 21 has a sufficiently smaller diameter with respect to the inside diameter of the air duct 5 as described above, the internal pressure of the air duct 5 increases with the resistance caused by the air passing through the small-diameter connection hole 21, and the air duct 5 constructed as a bellows type tube as mentioned above is extended in the axis direction by the function of the internal pressure thus produced, and consequently the base plate 2 supported by the air duct 5 is pushed downward by this extension.

Figure 5:
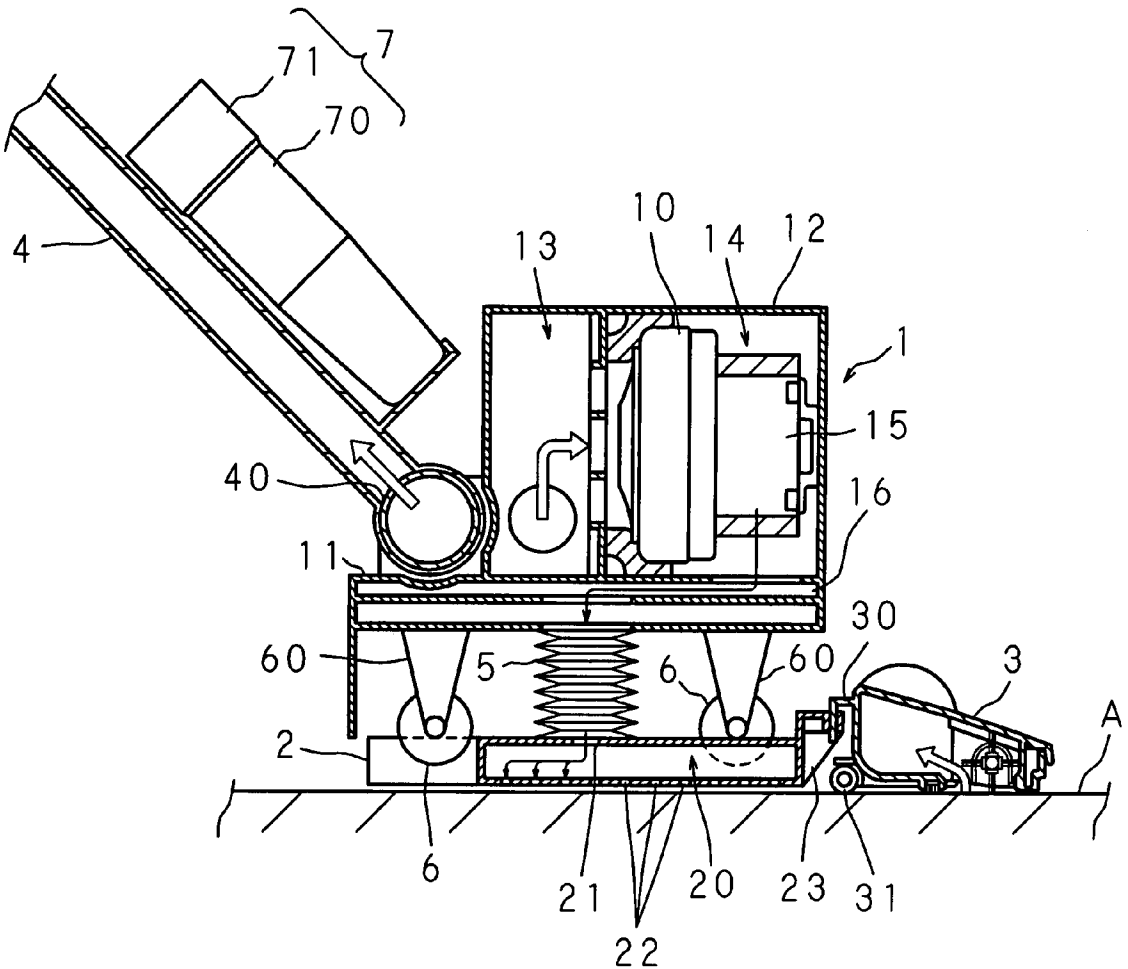
FIG. 5 is a sectional side view showing a state of the electric vacuum cleaner during a cleaning operation shown in FIG. 1.

FIG. 5 is a sectional side view showing a state of the electric vacuum cleaner during a cleaning operation shown in FIG. 1. As shown in FIG. 5, the base plate 2 pushed downward by the extension of the air duct 5 is pressed against the opposing surface A to be cleaned, which is located under the base plate 2, and the cleaner body 1 pushed upward by the reaction force of this pressing force separates the wheels 6, 6 and 6 from the surface A to be cleaned, and is supported on the surface A to be cleaned through the base plate 2. On the other hand, exhaust air is blown from a plurality of exhaust holes 22, 22, . . . in the lower face of the base plate 2, and an air layer is formed between the base plate 2 and the surface A to be cleaned by the exhaust air blown from the respective exhaust holes 22, 22, . . . . Thus, the base plate 2 and the cleaner body 1 supported by this base plate 2 are caused to float on the surface A to be cleaned by the function of the exhaust air from the intake fan 10, and the cleaner body 1 thus floating can be moved forward, backward, left and right without resistance by the pushing and pulling operation of the control handle 4 performed by a user holding the grip 46 at the top end.

In the above-described embodiment, as shown in FIG. 2, many exhaust holes 22, 22, . . . are formed in the base plate 2, and the exhaust air is blown from the respective holes. Therefore, the floating state of the base plate 2 on the surface A to be cleaned becomes stable, and it is possible to smoothly move the cleaner body 1 under the floating condition. However, the number and arrangement of the exhaust holes 22, 22, . . . are not limited to those shown in FIG. 2, and may be suitably selected.

As described above, when the base plate 2 is pushed down, the dust suction nozzle 3 attached to the front part of the base plate 2 is also lowered onto the surface A to be cleaned, supported on the surface A to be cleaned by the support roller 31 suspended on the rear side of the dust suction port as shown in FIG. 5, and moved with the above-mentioned movement of the base plate 2 and the cleaner body 1 through the rolling of the support roller 31. During this movement, dust on the surface A to be cleaned are sucked by the function of negative pressure produced in the dust suction port of the dust suction nozzle 3, transported by the above-mentioned flow of suction air, and collected in the dust collection chamber 70 of the cyclone dust collector 7. As described above, the dust suction nozzle 3 is supported to allow for relative displacement with respect to the base plate 2 in the vertical direction, and it is possible to keep the supported state in which the support roller 31 rolls in contact with the surface A to be cleaned, irrespective of a change in the floating state of the base plate 2, and it is possible to satisfactorily suck dust from the dust suction port near the surface A to be cleaned.

As described above, in the electric vacuum cleaner of the present invention, since the cleaner body 1 incorporating the intake fan 10 is caused to float on the surface A to be cleaned by the function of exhaust air produced by driving the intake fan 10, the user holding the grip 46 at the upper end of the control handle 4 can smoothly push, pull and move the cleaner body 1 without resistance over the surface A to be cleaned, and thus it is possible to execute cleaning with light operating feeling and achieve more convenient use of the electric vacuum cleaner.

Moreover, since the cyclone dust collector 7 as a dust collecting section is provided in a mid part of the control handle 4, it is possible to construct the cleaner body 1 in small size capable of incorporating the intake fan 10 including the suction chamber 13 and the exhaust chamber 14, and it is possible to achieve improved handling by the size reduction.

In addition, the supporting wheels 6, 6 and 6 are mounted on the cleaner body 1. Hence, even when the intake fan 10 is not driven and therefore the above-mentioned floating force is not produced by the exhaust air, the cleaner body 1 is supported by the wheels 6, 6 and 6, and it is possible to move the cleaner body 1 without damaging the surface A to be cleaned. On the other hand, the outlets (exhaust holes 22, 22, . . . ) of the exhaust air from the intake fan 10 are formed in the base plate 2 connected through the freely extensible air duct 5, the wheels 6, 6 and 6 are separated from the surface A to be cleaned by the up-and-down movement of the base plate 2, and the cleaner body 1 is supported in a floating manner by the exhaust air blown from the exhaust holes 22, 22, . . . . With this structure, it is possible to realize a stable floating state irrespective of the presence or absence of the wheels 6, 6 and 6.

Further, since the base plate 2 is moved up and down by using the extension of the air duct 5 caused by the passage of the exhaust air, it is not necessary to provide an actuator for use exclusively for the up-and-down movement, thereby simplifying the structure. Needless to say, a structure comprising an actuator for use exclusively for moving up and down the base plate 2, such as a pneumatic cylinder, is also included within the technical scope of the invention.

Figure 6:
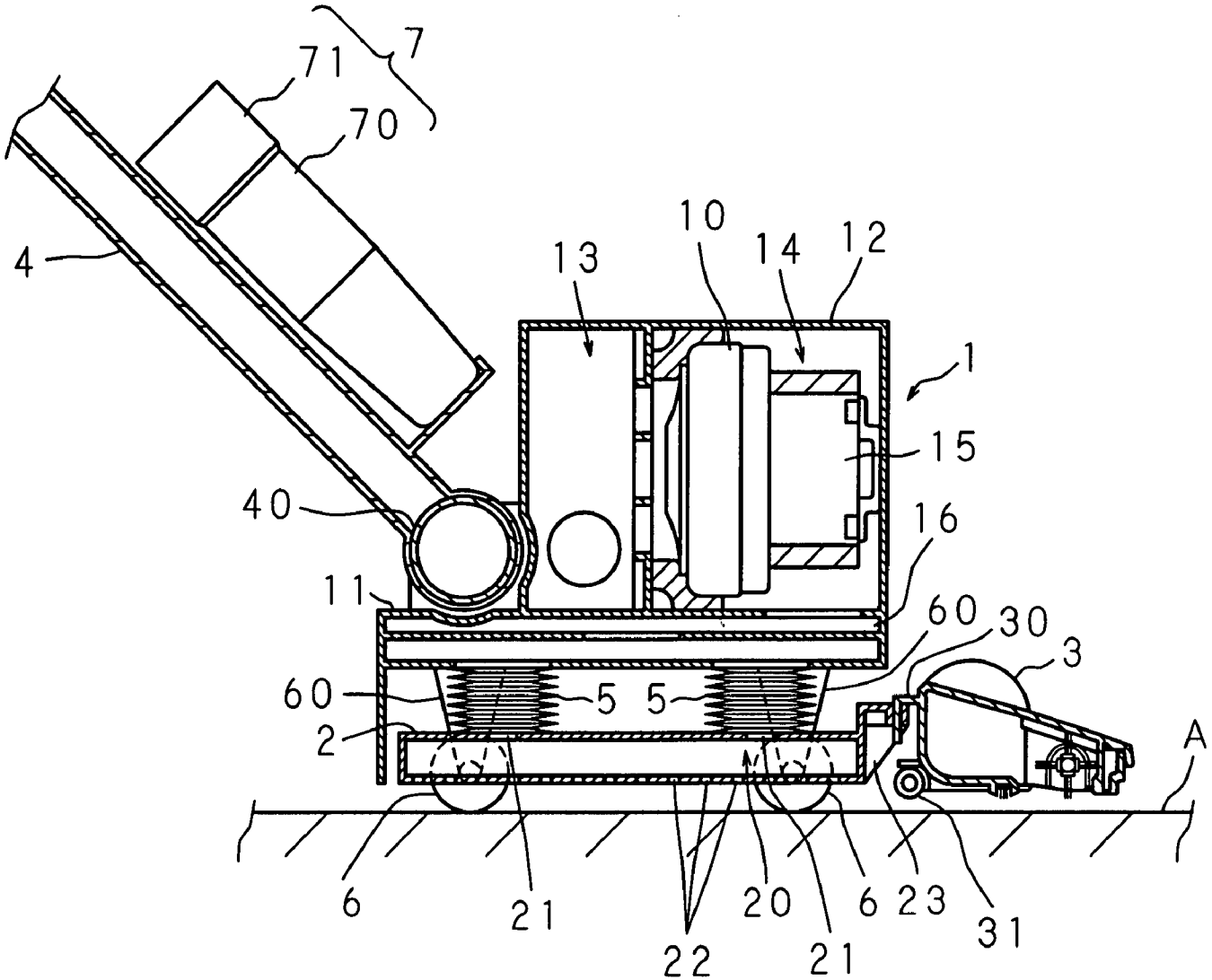
FIG. 6 is a sectional side view showing a second embodiment of an electric vacuum cleaner according to the present invention.

FIG. 6 is a sectional side view showing a second embodiment of an electric vacuum cleaner according to the present invention. In the electric vacuum cleaner shown in FIG. 6, two air ducts 5, 5 constructed as bellows type tubes are interposed between the cleaner body 1 and the base plate 2, the exhaust air from the intake fan 10 is guided into the exhaust chamber 20 in the base plate 2 through these air duct 5, 5 and emitted from the exhaust holes 22, 22, . . . formed in the bottom face of the exhaust chamber 20.

The inflow of exhaust air from the air ducts 5, 5 into the exhaust chamber 20 is produced through small-diameter connection holes 21, 21 formed through the corresponding positions in the top face of the exhaust chamber 20. The air ducts 5, 5 are extended by the function of internal pressure produced by the resistance caused by the passage of air through the respective connection holes 21, 21, and also performs the function of an actuator for pushing down the base plate 2. Since the structures of other parts are the same as those of the first embodiment shown in FIG. 1, the corresponding component members are assigned with the same reference codes as FIG. 1, and the explanations of the structures and operations are omitted.

In this embodiment, it is possible to stabilize the floating state of the cleaner body 1 by sharing the weight of the floating cleaner body 1 through the base plate 2 with the two air ducts 5, 5, and it is also possible to decrease the strength requirement for the air ducts 5 and 5 that also act as the actuator for moving up and down the base plate 2. Note that it may be possible to increase the number of the air ducts 5 to three or more within a range in which the air ducts 5 can be interposed between the cleaner body 1 and the base plate 2.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An electric vacuum cleaner including a cleaner body incorporating an intake fan for generating suction for sucking dust and supported in a floating manner on a surface to be cleaned by exhaust air blown from the intake fan, comprising:

a base plate connected to a lower face of the cleaner body so that the base plate is freely movable up and down with respect to the lower face of the cleaner body and having an outlet of the exhaust air formed in a surface thereof facing the surface to be cleaned;

an extensible air duct, interposed between the base plate and the cleaner body, for guiding the exhaust air from the intake fan to the base plate;

a dust suction nozzle supported on a part of the base plate and connected to a suction side of the intake fan; and wheels, mounted on the lower face of the cleaner body, for supporting the cleaner body on the surface to be cleaned when the base plate is moved up.

2. The electric vacuum cleaner according to claim 1, wherein the air duct is extended or contracted according to passage or non-passage of the exhaust air, and also acts as an actuator for moving up and down the base plate.

3. The electric vacuum cleaner according to claim 2, wherein a plurality of the air ducts are provided between the base plate and the cleaner body.

4. The electric vacuum cleaner according to claim 3, wherein the air ducts are bellows type tubes having a bellows-like circumferential surface.

5. The electric vacuum cleaner according to claim 2, wherein the air duct is a bellows type tube having a bellows-like circumferential surface.

6. The electric vacuum cleaner according to claim 1, wherein a plurality of the outlets are formed in a surface of the base plate facing the surface to be cleaned.

7. The electric vacuum cleaner according to claim 1, wherein a plurality of the wheels are mounted on the lower face of the cleaner body.

8. The electric vacuum cleaner according to claim 1, wherein the dust suction nozzle is supported so that the dust suction nozzle is displaceable in a vertical direction with respect to the base plate.

* * * * *